United States Patent [19]

Zimmerman

[11] Patent Number: 4,575,010

[45] Date of Patent: Mar. 11, 1986

[54] METHOD AND APPARATUS FOR SPREADING HEATED SAND

[76] Inventor: Harold M. Zimmerman, R.D. 1, Wabash Rd., Ephrata, Pa. 17522

[21] Appl. No.: 622,375

[22] Filed: Jun. 20, 1984

[51] Int. Cl.[4] ..... B05B 1/24; B61C 15/10

[52] U.S. Cl. ..... 239/650; 239/130; 239/135; 239/674; 239/675; 291/20

[58] Field of Search ..... 239/1, 13, 650, 672, 239/674, 675, 676, 135, 130; 291/41, 46, 47, 19–21; 366/21, 319, 144, 149

[56] References Cited

U.S. PATENT DOCUMENTS

| | | | |
|---|---|---|---|
| 475,618 | 5/1982 | Skinner | 366/21 |
| 1,165,331 | 12/1915 | Gray . | |
| 2,060,652 | 11/1936 | Arnold | 239/675 X |
| 2,303,876 | 12/1942 | Gaddis | 239/674 |
| 2,490,971 | 12/1949 | Lawson et al. | 239/674 X |
| 2,529,197 | 11/1950 | Storbey . | |
| 2,554,769 | 5/1951 | Arnold | 366/319 |
| 3,235,107 | 2/1966 | Tift . | |
| 3,399,917 | 9/1968 | McLean . | |
| 3,768,737 | 10/1973 | Tobias . | |
| 4,022,386 | 5/1977 | Cayne . | |
| 4,162,766 | 7/1979 | Broeck et al. . | |
| 4,234,109 | 11/1980 | Goodhart | 239/675 X |

FOREIGN PATENT DOCUMENTS

| | | | |
|---|---|---|---|
| 146510 | 5/1952 | Australia | 239/674 |
| 557865 | 5/1958 | Canada | 239/650 |
| 616582 | 3/1961 | Canada . | |
| 936841 | 6/1982 | U.S.S.R. | 239/675 |

*Primary Examiner*—Andres Kashnikow
*Assistant Examiner*—Mary Beth O. Jones
*Attorney, Agent, or Firm*—Michael R. Swartz; John R. Flanagan

[57] ABSTRACT

A heated sand spreader apparatus has an inclined elongated screw conveyor mounted at the rear end of a mobile chassis for receiving and conveying sand in a rearward direction along a spiraling path. A plurality of heat generators are attached to the conveyor for directing heat on the sand grains moving within the conveyor. The grains are heated to such a degree that upon subsequent contact with ice on a road surface the grains will melt the ice and deposit in it. After the ice refreezes the grains form a granular surface on the ice. The apparatus includes a broadcast-type spreader supported from the auger conveyor which receives heated sand therefrom and is operated to uniformly broadcast the sand grains on the road surface at the rear of the mobile chassis.

6 Claims, 3 Drawing Figures

3
3

METHOD AND APPARATUS FOR SPREADING HEATED SAND

CROSS REFERENCE TO RELATED APPLICATION

Reference is hereby made to the following co-pending U.S. application dealing with subject matter related to the present invention; "Improved Method and Machine for Producing Asphalt" by Harold M. Zimmerman, U.S. Ser. No. 622,616, filed June 20, 1984.

BACKGROUND OF THE INVENTION

1. Field Of The Invention

The present invention relates generally to the treatment of icy road surfaces with sand and, more particularly, is concerned with a method and apparatus for spreading sand heated sufficiently to cause formation of a "sand paper" road surface.

2. Description Of The Prior Art

It is standard practice in many regions of the United States to treat icy road surfaces by spreading salt crystals from a moving vehicle. The salt crystals react with ice and snow to form a solution having a freezing point which is lower than that of water alone. As a result, the ice melts and the hazardous driving conditions are alleviated. However, the use of salt crystals has many important disadvantages. First, salt does not react with ice at temperatures below 18 degrees Fahrenheit. Second, salt is very destructive of highways and bridges in that it causes deterioration of concrete. Third, the bodies of automobiles experience high degrees of corrosion and rusting in areas of the country where salt is commonly use on the highways. Finally, considerable damage to cropland and pollution of ground water results from runoff of salt-laden water from highways and streets into streams and storm sewers.

In view of the negative aspects of salt, in parts of the country where sand or grit or the like are plentiful they are often substituted for salt. Many different sand distributing devices and mechanisms are known in the prior art. Exemplary devices for providing sand or grit for distribution on icy roads are disclosed by a U.S. patent to McLean (3,399,917) and a Canadian patent to Micheletz (616,582). McLean discloses a pair of sand containers mounted on the frame of a truck for dispensing sand, via an auger, through a discharge tube ahead of the truck wheels. The discharge tube connects the exhaust of the truck to the containers for heating the sand to prevent it from freezing in the containers. Micheletz is similarly directed to an apparatus for applying sand in front of the wheels of a vehicle. The sand boxes are connected to the tail pipe to keep the sand dry and prevent it from freezing. Also, a U.S. patent to Storberg (2,539,197) is directed to the same type of apparatus; however, no heat is applied to the sand. Another U.S. patent to Ten Broeck et al. (4,162,766) shows a conventional apparatus for spreading materials on icy roads which includes a hopper, unloading conveyor and a spreader mechanism. To this conventional apparatus is added an auxiliary hopper for mixing and discharging a second material, such as salt, with the first material (which is cinders). Alternatively, material from the auxiliary tank can be discharged by an auger onto a spreader.

Other U.S. patents to Tift (3,235,107), Arnold (2,060,652) and Tobias (3,768,737) merely disclose devices which distribute sand per se, such as by the use of an auger conveyor to deliver sand to a rotary spreader. Two other U.S. patents to Gray (1,165,331) and Caye (4,022,386) are representative of other spreader devices found in the prior art.

While many of the devices in the above-cited representative prior art patents undoubtedly operated satisfactorily and achieved their objectives under a narrow range of operating conditions for which they were designed, It is not seen that any of these devices propose to handle sand and like materials in a way which extends or enhances the utility of sand as a more or less universal substitute for salt in the treatment of icy road conditions. Consequently, a need exists for further improvements in sand spreading techniques which will more effectively utilize sand as an common remedy for hazardous icy roads.

SUMMARY OF THE INVENTION

The present invention provides an improved heated sand spreading method and apparatus designed to satisfy the aforementioned needs. Underlying the present invention is the recognition that the effectiveness of sand as a medium for reducing hazardous driving conditions is enhanced when the sand grains become embedded into the surface of the ice, forming a "sand paper"-like road surface in conjunction with the layer of ice. Such type of road surface in turn increases the traction of vehicle tires and concomitantly reduces the likelihood of skidding. The unique solution offered by the technique of the present invention is to heat the sand grains so that they contain sufficient heat upon contact with the ice surface to melt it, thereby depositing themselves in the ice and after which the ice surface refreezes and forms the "sand paper" quality surface. Also, experience demonstrates that the cost of heat plus sand in some regions is only fifty percent of the cost of salt alone.

Accordingly, the present invention is directed to a method and apparatus for spreading heated sand which utilizes the following combination of operative steps: (a) receiving the sand at an inlet end of an elongated chamber; (b) conveying the sand through the chamber in a first direction from the inlet end toward a discharge end of the chamber while simultaneously flinging the sand in a second direction generally transverse to the first direction so as to move the grains of sand in a generally spiraling path; (c) directing heat both generally axially through and transversely across the chamber as the sand is being conveyed through the chamber for heating the sand grains to the degree that they contain sufficient heat so that upon subsequent contact with ice on a road surface they will melt, and deposit into, the ice and after the ice refreezes form a granular surface with the ice; and (d) receiving the heated sand from the discharge end of the chamber and spreading the heated sand grains in broadcast fashion on ice on the road surface. Further, heat is directed into a cavity which is coextensive with and surrounds the elongated chamber for adding heat to the chamber and the sand being conveyed therein.

These and other advantages and attainments of the present invention will become apparent to those skilled in the art upon a reading of the following detailed description when taken in conjenction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE PREFERRED EMBODIMENT

In the following description, right hand and left hand references are determined by standing at the rear of the apparatus and facing in the direction of forward travel. Also, in the following description, it is to be understood that such terms as "forward," "left," "upward," etc., are words of convenience and are not to be construed as limiting terms.

In General

Figure 1:
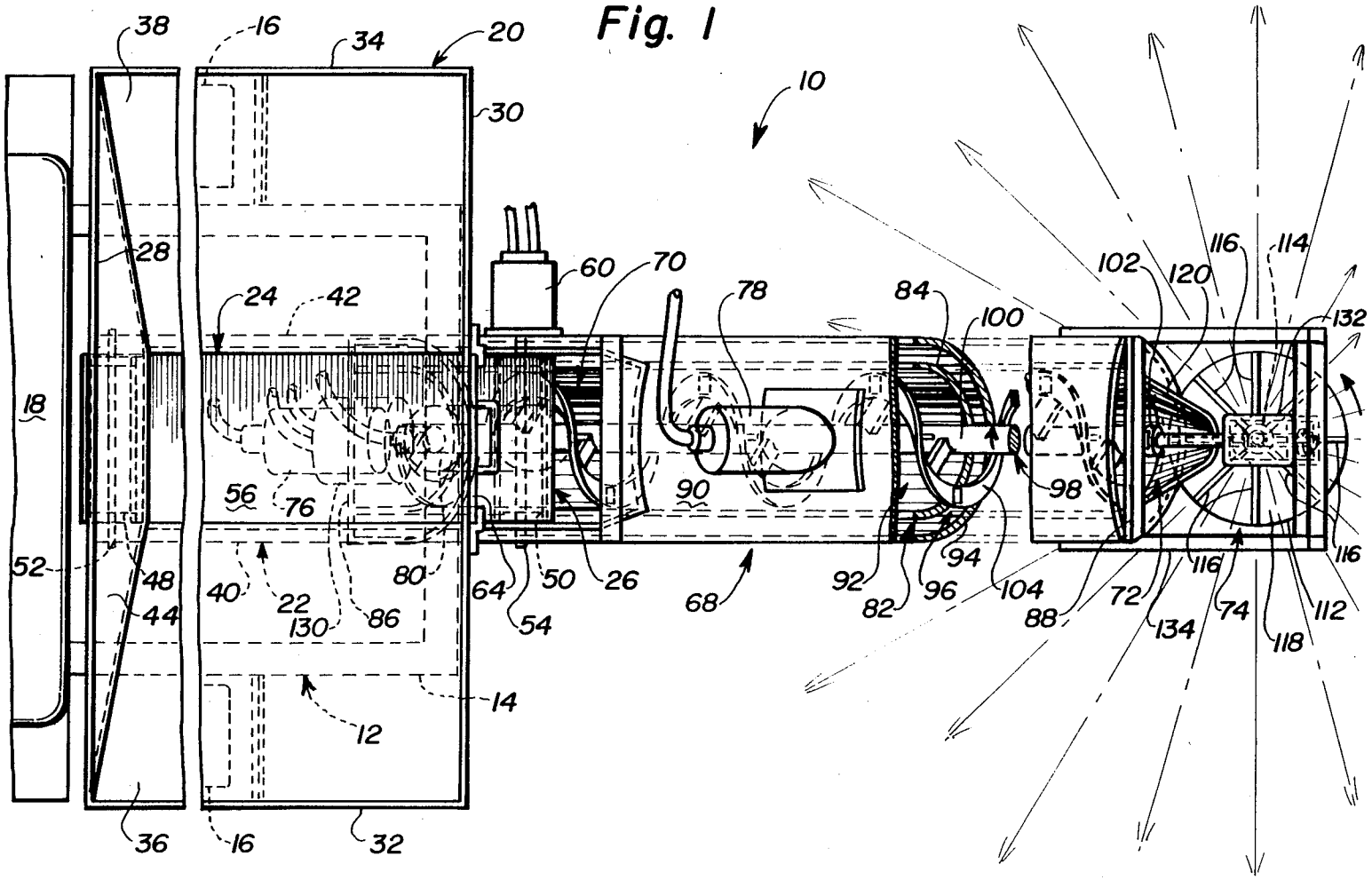
FIG. 1 is a fragmentary top plan view, partially in section, of an apparatus for spreading heated sand embodying the principles of the present invention.
Figures 2, 3:
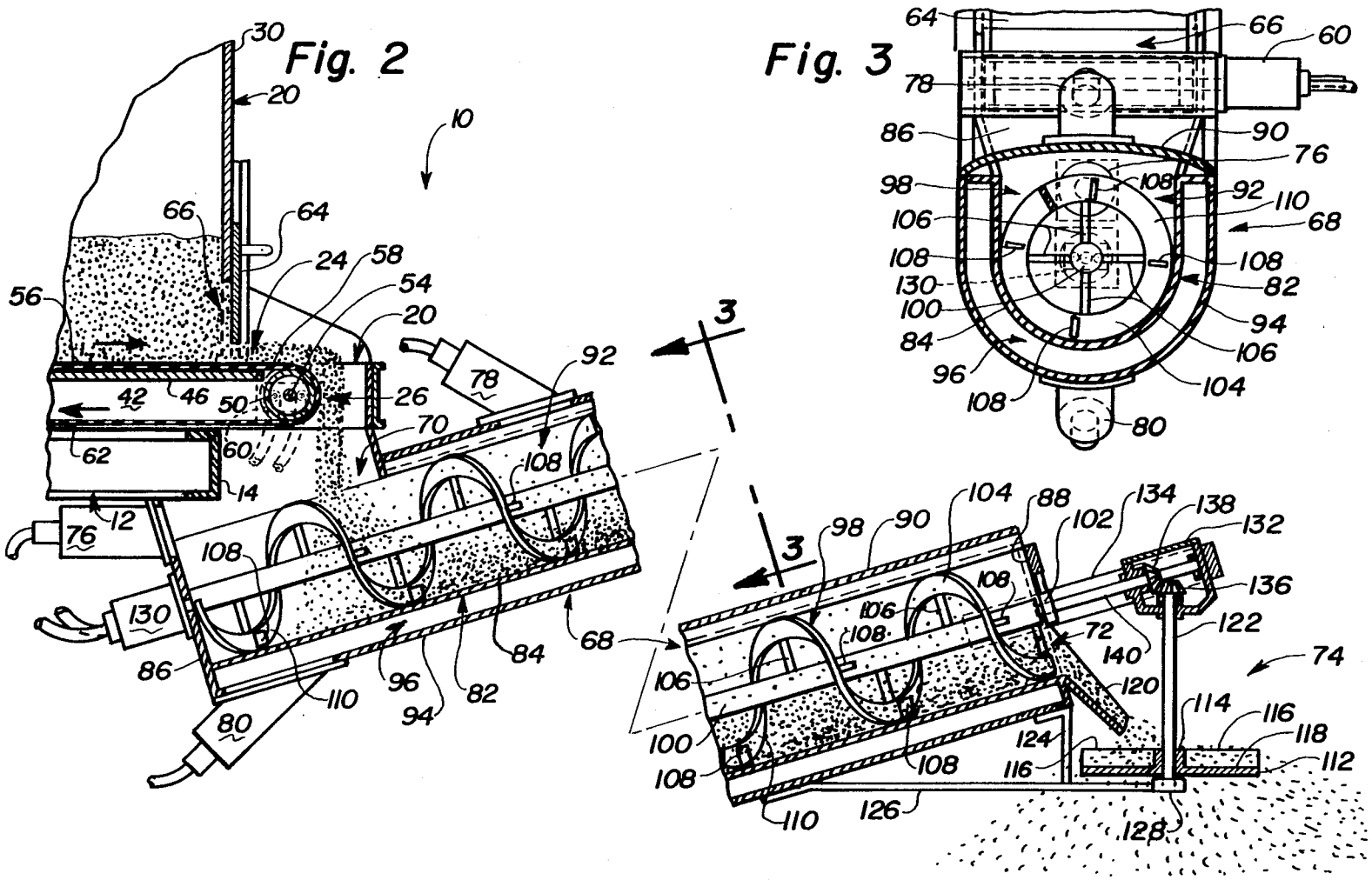
FIG. 2 is a fragmentary sectional view, partially in elevation, as seen through the longitudinal center of the apparatus in FIG. 1.
FIG. 3 is an enlarged sectional view of the sand conveying and heating chamber of the apparatus as seen looking forward along line 3—3 in FIG. 2.

Referring now to the drawings, and particularly to FIGS. 1 and 2, there is shown an apparatus for spreading heated sand on an icy road surface, the apparatus being indicated generally by numeral 10 and forming the preferred embodiment of the present invention. The left side of the apparatus is shown in FIG. 2 when one is standing to the rear of the apparatus and facing in the direction of forward travel.

The heated sand spreading apparatus 10 is mounted on a mobile chassis, generally indicated at 12, being in the preferred embodiment a conventional truck chassis. The mobile chassis 12 includes a load bed 14 supported by rear wheels 16 and front wheels (not shown) with a cab 18 mounted on its front portion. A sand storage tank 20 mounted on the rear portion of the load bed 14 has a central bottom trough 22 extending in the direction of travel of the chassis and a belt conveyor 24 operatively disposed in the trough for delivering sand contained in the storage tank 20 to a rear discharge end 26.

The storage tank 20 has front and rear, generally vertical, end walls 28,30 and left and right, generally vertical, side walls 32,34 which extend between and interconnect the front and rear end walls. The tank also has a pair of left and right bottom walls 36,38 which interconnect respective left and right side walls 32,34 and respective upper longitudinal edges of left and right upright sides 40,42 of the bottom trough 22. The bottom walls 36,38 also are oppositely inclined from one another so as to slope in converging fashion from respective ones of the vertical side walls 32,34 downwardly toward respective upright sides 40,42 of the trough 22. Further, a lower portion 44 of the front end wall 28 is inclined rearwardly such that a forward portion of the trough 22 extends forwardly beyond the inclined front end wall portion. The lower portion 44 also connects with the left and right bottom walls 36,38.

The bottom trough 22 has the laterally spaced, generally upright sides 40,42 and a generally horizontal upper floor 46 which interconnects the sides at their respective upper longitudinal edges. The trough 22 is thereby closed at its top. The bottom trough 22 serves as a frame for the belt conveyor 24. A pair of rollers 48,50 on shafts 52,54 are rotatably mounted across opposite ends of the sides 40,42 of the trough 22. An endless belt 56 extends about the rollers 48,50. An upper sand carrying run 58 of the belt 56 moves in a rearward direction along and above the upper trough floor 46 when a hydraulic motor 60 mounted to trough side 42 and drivingly coupled to rear roller shaft 54 is turned on, such as by the operator from the cab of the truck. A lower return run 62 of the belt 56 moves in a forward direction along and under the upper trough floor 46 when the motor 60 is operated.

Therefore, operation of hydraulic motor 60 moves the belt 56 in a clockwise direction, as seen in FIG. 2, and delivers sand in the storage tank 20 to the discharge end 26 of the conveyor 24. A gate 64 mounted for vertical sliding movement on the exterior of the rear end wall 30 of the tank 20 and across an opening 66 defined in the wall 30 just above the conveyor 24 may be adjusted by the operator to regulate the rate of sand discharge by the belt conveyor 24.

From the discharge end 26 of the belt conveyor 24, sand is delivered by gravity to the heated sand spreading apparatus 10. The apparatus 10 includes an elongated screw conveyor, generally designated 68, mounted at its forward end to the rear end of the load bed 14 and of the trough 22 which extends beyond the rear end of the load bed. The screw conveyor 68 is supported from the load bed 14 and trough 22 so as to extend in inclined fashion upwardly and rearwardly therefrom. Also, mechanisms for injecting heat into the screw conveyor 68 and onto the sand grains as they are being conveyed by the conveyor 68 are mounted on the conveyor in communication with the sand therein. Thus, as sand received at an inner, lower inlet end 70 of the screw conveyor 68 is conveyed in a generally inclined spiraling path toward an outer, upper discharge end 72 of the conveyor, the sand grains are heated to such a degree that upon subsequent contact with ice on a road surface the grains will melt the ice and deposit into it. After the ice refreezes the grains form a granular surface on the ice.

Conveying, Heating And Spreading Sand

Turning also to FIG. 3, as well as referring to FIGS. 1 and 2, there is depicted the arrangement of the screw conveyor 68, sand spreader 74 and a plurality of heat generators 76,78,80, being preferably three in number, forming the preferred embodiment of the heated sand spreading apparatus 10 of the present invention.

The screw conveyor 68 includes a longitudinally extending generally inclined trough 82 having a generally U-shaped elongated side wall 84 and opposite fore and aft end walls 86,88. A removable cover 90 encloses side wall 84 at the top thereof and terminates short of the inner end of the trough 82 so as to form the inlet end 70 of the screw conveyor 68. The trough 82 and cover 90 together define an elongated generally inclined chamber 92 having the inlet and discharge ends 70,72 of the screw conveyor 68. The conveyor 68 also includes a generally U-shaped casing 94 attached to and surrounding the trough 82 in a spaced relationship so as to define a U-shaped cavity 96 therebetween which is substantially coextensive with the chamber 92.

Further, the screw conveyor 68 includes an elongated auger 98 mounted in the elongated chamber 92. The auger 98 has a central shaft 100 extending between and rotatably mounted at opposite ends to the fore end wall 86 and a hanger bearing 102 supported on the aft end wall 88 of the trough 82. A ribbon flighting 104 is supported in spaced relationship to, and spiraling relationship about, the shaft 100 by a plurality of spokes 106 which extend radially from the shaft and are spaced in angularly offset relationship, such as 90 degrees, one from the next along and about the shaft. Also, a plurality of axially protruding paddles 108 are attached to an advancing face 110 of the ribbon flighting 104. Upon rotation of the auger 98, the sand is conveyed in a spiraling path through coaction of the ribbon flighting 104 and the paddles 108 on the flighting. First, the flighting 104 conveys the sand grains through the chamber 92 in a first direction from the inlet end 70 toward the discharge end 72 of the chamber 92. Second, simultaneously, the paddles 108 on the flighting 104 engage the sand grains and fling them in a second direction generally transverse to the first direction. Such coaction produces a flury of sand grains moving in a generally spiraling path defined by the ribbon flighting 104.

The heat generators 76,78,80, preferably in the form of butane cylinders, are attached to the screw conveyor 68 for directing heat on the sand being conveyed in the chamber 92 and on the trough 82. The first heat generator 76 is attached to the fore end wall 86 of the trough 82 forwardly of the inlet end 70 of the chamber 92 and aligned generally in the axial direction of the auger shaft 100. Heat generator 76 directs heat within the chamber space including the space between the ribbon flighting 104 and the auger shaft 100 so as to heat sand grains as they enter through the inlet end 70 and begin movement along the spiraling path toward the outer discharge end 72 of the chamber 92. The second heat generator 78 is attached to the cover 90 above the trough 82 and rearwardly of the inlet end 70 of the chamber 92. This heat generator 78 directs heat more or less transversely across the chamber 92 and onto the sand grains moving along the spiraling path. Finally, the third heat generator 80 is attached to the casing 94 opposite the inlet end 70 of the chamber 92 for directing heat into the cavity 96. The heat in the cavity 96 maintains the trough side wall 84 at an elevated temperature which, in turn, adds heat to the sand grains being conveyed within the chamber 92.

It will be noted that due to the inclined disposition of the screw conveyor 68, heat introduced into the inclined chamber 92 and cavity 96 near the lower inlet end 70 of the chamber will also rise and flow along the chamber and cavity toward the upper discharge end 72 of the chamber 92. Therefore, the sand is maintained in a heated environment throughout the duration of its stay within the chamber 92. As a result, the sand grains discharged from the discharge end 72 of the chamber 92 and delivered by gravity to the spreader 74 will still contain substantial amounts of heat.

Finally, the sand spreader 74 of the apparatus 10 includes a circular broadcasting plate 112 having a central hub 114 and a plurality of vertically upstanding blades 116 fixed on the top surface 118 of the plate and extending radially from the hub 114. The broadcasting plate 112 is disposed in a generally horizontal orientation below a spout 120 on the discharge end 72 of the conveyor 68 through attachment to a shaft 122 of the spreader 74 which is rotatably mounted in a vertical orientation rearwardly of the screw conveyor 68. A pair of brackets 124,126 fixed at a right angle to one another and fixed to the casing 94 rotatably mount the spreader shaft 122 in bearing 128 on bracket 126. In this positional relationship, the plate 112 receives the heated sand discharging from the chamber 92 via spout 120 and broadcasts it throughout a large circular region, as indicated by the radially directed arrows in FIG. 1, behind the mobile chassis 12 as it moves along an ice and snow covered road.

The auger 98 of the screw conveyor 68 is powered by a hydraulic motor 130 coupled to its central shaft 100 and mounted to the fore end wall 86 of the trough 82. The same motor 130 indirectly powers the broadcasting plate 112 of the spreader 74. A gearbox 132 is supported by a rectangular frame 134 on the outer end of the screw conveyor 68. The gearbox 132 rotatably mounts an upper end of the spreader shaft 122 such that a driven bevel gear 136 on the shaft is in intermeshed, drive coupling relationship with a drive bevel gear 138. The latter gear 138 is attached on the outer end of a drive shaft 140 also rotatably mounted in the gearbox 132 and connected to the outer end of the auger shaft 100. Thus, the rotary motion needed to drive the broadcasting plate 112 of the spreader 74 is provided via the intercoupled auger central shaft 100, drive shaft 140, and spreader shaft 122.

It is thought that the invention and many of its attendant advantages will be understood from the foregoing description and it will be apparent that various changes may be made in the form, construction and arrangement of the parts of the apparatus described and that changes may be made in the steps of the method described and their order of accomplishment without departing from the spirit and scope of the invention or sacrificing all of its material advantages, the form hereinbefore described being merely a preferred or exemplary embodiment thereof.

I claim:

1. In an apparatus for spreading heated sand on ice on a road surface, the combination comprising:

(a) a longitudinally extending, inclined trough having a generally U-shaped elongated side wall and opposite fore and aft end walls;

(b) a cover enclosing said side wall at the top thereof and, in conjunction with said side wall, defining an elongated inclined chamber, said cover terminating short of said fore end wall of said trough so as to define a lower inlet end of said inclined chamber and said side wall of said trough having an opening therein at one end which forms an upper discharge end of said inclined chamber;

(c) an elongated generally inclined auger disposed in said inclined chamber, said auger including (i) a central shaft extending between and rotatably mounted at opposite ends to said fore and aft end wall of said inclined trough, (ii) a ribbon flighting, (iii) a plurality of spokes extending radially from said shaft and spaced therealong in angularly offset relationships for supporting said ribbon flighting in spaced relationship to, and spiraling relationship about, said shaft, and (iv) a plurality of axially protruding paddles attached to an advancing face of said ribbon flighting for aggressively flinging the sand outwardly upon rotation of said inclined auger such that a flury of sand grains moving along an inclined spiraling path is formed in said inclined trough as said auger rotates therein;

(d) a first heat generator attached to said fore end wall of said inclined trough forwardly of said lower inlet end of said inclined chamber and aligned generally in the axial direction of said auger shaft for directing heat generally axially through said chamber and directly on the sand grains being conveyed therein;

(e) a second heat generator attached to said cover above said inclined trough and rearwardly of said lower inlet end of said inclined chamber for directing heat generally transversely across said chamber and directly on the sand grains being conveyed therein;

(f) a generally inclined U-shaped casing attached to and surrounding said inclined trough in a spaced relationship so as to define an inclined cavity for heating said trough and thereby adding heat to said inclined chamber and the sand being conveyed therein;

(g) a third heat generator attached to said inclined casing opposite to said lower inlet end of said inclined chamber for directing heat into said cavity for heating said inclined trough and thereby adding heat to said chamber and the sand being conveyed therein; and (h) a spreader supported from said inclined trough and including a rotatable broadcasting plate horizontally disposed below said upper discharge end of said inclined chamber for receiving the heated sand from said discharge end of said chamber and for spreading the heated sand grains in broadcast fashion on ice on the road surface.

2. In an apparatus for spreading heated sand on ice on a road surface, the combination comprising:

(a) means defining an elongated generally inclined chamber having a lower inlet end and an upper discharge end, said chamber defining means including (i) a trough having a generally U-shaped elongated side wall and opposite fore and aft end walls, and (ii) a cover enclosing said side wall at the top thereof, said cover terminating short of said fore end wall of said trough so as to define said inlet end of said chamber;

(b) means for conveying the sand received at said lower inlet end of said inclined chamber in a first direction through said chamber from said lower inlet end toward said upper discharge end thereof while simultaneously flinging the sand in a second direction generally transverse to the first direction so as to move the grains of sand in a generally inclined spiraling path, said conveying means including an elongated auger disposed in said chamber, said auger including (i) a central shaft extending between and rotatably mounted at opposite ends to said fore and aft end walls of said trough, (ii) a ribbon flighting, (iii) a plurality of spokes extending radially from said shaft and spaced therealong in angularly offset relationships for supporting said ribbon flighting in spaced relationship to, and spiraling relationship about, said shaft, and (iv) a plurality of axially protruding paddles attached to an advancing face of said ribbon flighting for aggressively flinging the sand outwardly upon rotation of said auger such that a flury of moving sand grains is formed in said trough as said auger rotates therein;

(c) means for directing heat both generally axially through and transversely across said inclined chamber directly on the sand grains as the sand is being conveyed through said chamber for heating the sand grains to the degree that they contain sufficient heat so that upon subsequent contact with ice on the road surface they will melt, and deposit into, the ice and after the ice refreezes form a granular surface with the ice, said heat directing means including (i) a first heat generator attached to said fore end wall of said trough forwardly of said inlet end of said chamber and aligned generally in the axial direction of said auger shaft, and (ii) a second heat generator attached to said cover above said trough and rearwardly of said inlet end of said chamber;

(d) means defining a generally inclined cavity which is coextensive with and surrounds said inclined sand conveying and heating chamber;

(e) means for directing heat into said inclined cavity for adding heat to said inclined chamber and the sand being conveyed therein; and (f) means for receiving the heated sand from said upper discharge end of said inclined chamber and for spreading the heated sand grains in broadcast fashion on ice on the road surface.

3. The heated sand spreading apparatus as recited in claim 2, further comprising:

(g) a mobile vehicle;

(h) said chamber defining means supported on said mobile vehicle; and (i) said spreading means supported on said chamber defining means.

4. The heated sand spreading apparatus as recited in claim 3, further comprising:

(j) a sand storage tank mounted on said mobile vehicle; and (k) means for delivering sand from said storage tank to said inlet of said chamber.

5. The heated sand spreading apparatus as recited in claim 2, wherein:

said cavity defining means is a generally U-shaped casing attached to and surrounding said trough in a spaced relationship so as to define said cavity; and said heat directing means for directing heat into said cavity is a heat generator attached to said casing opposite to said inlet end of said chamber.

6. The heated sand spreading apparatus as recited in claim 2, wherein said heated sand receiving and spreading means includes a rotatable broadcasting plate horizontally disposed below said discharge end of said chamber.

* * * * *